United States Patent [19]

Heinzle

[11] Patent Number: 4,543,897

[45] Date of Patent: Oct. 1, 1985

[54] SHUTTLE EMBROIDERING MACHINE

[76] Inventor: August Heinzle, Altweg 9, A-6844 Altach, Austria

[21] Appl. No.: 479,214

[22] Filed: Mar. 28, 1983

[30] Foreign Application Priority Data

Mar. 29, 1982 [AT] Austria ..... 1200/82

[51] Int. Cl.[4] ..... D05B 3/12

[52] U.S. Cl. ..... 112/221; 112/84; 112/89; 112/98

[58] Field of Search ..... 112/98, 89, 221, 84

[56] References Cited

U.S. PATENT DOCUMENTS 4,426,941 1/1984 Comploi et al. ..... 112/84

4,434,728 3/1984 Comploi et al. ..... 112/221

FOREIGN PATENT DOCUMENTS 2900804 7/1980 Fed. Rep. of Germany ..... 112/221

*Primary Examiner*—Ronald Feldbaum

*Attorney, Agent, or Firm*—Toren, McGeady, Stanger, Goldberg & Kiel

[57] ABSTRACT

In a shuttle embroidering machine a plurality of needle carriers and drill carriers are arranged to be displaced at approximately right angles relative to the plane of an embroidery frame. Each needle carrier has a needle inserted into one end and each drill carrier has a drill inserted into one end. A generally horizontally extending arm is attached to the opposite end of each needle carrier and drill carrier. The arms are pivotally displaceable about a horizontal axis. One end of each arm is connected to a needle carrier or a drill carrier and the other end is displaceable along a path due to the pivotal displaceability of the arms about horizontal axes. A drive element provides the operative displacement of the needle carriers and drill carriers. The arms are shaped for selective form-locking engagement with the drive element. Individually controllable locking members are located in the path of displacement of the ends of the arms spaced from the needle carriers and drill carriers so that the needle carriers and drill carriers can be held in an inoperative position. Control members are engageable with the arms for selectively pivoting the arms into or out of locking engagement with the locking arms.

28 Claims, 7 Drawing Figures

SHUTTLE EMBROIDERING MACHINE

The invention relates to a shuttle embroidering machine with needle carriers and drill carriers displaceable approximately at right angles relative to the plane of the embroidery frame, as well as a drive element for working displacement of the former; arms, which are at least supported so as to swivel around a horizontal axis, are fastened at those ends of the needle carrier and drill carrier which are remote of the needles and drills, respectively, said arms having recesses, projections, or the like, for a form-locking working connection with the drive element; and wherein the arms can be placed in a working connection with mechanical, pneumatic and/or electrical control elements for engaging and disengaging of the arms relative to the drive element.

In a known construction of this type the primary concern is that the needle carrier, as well as the drill carrier, be held so as to be displaceable in horizontal guides of a stationary bar and that the arms arranged at the needle carriers and drill carriers can be placed in a working connection with the same drive element. Control elements are provided which raise the arms from the drive element or permit a swivelling against the drive element according to the position of the arms. In such an embodiment all the arms of the needle carrier or drill carrier not in use must be held in a raised position; on the other hand, problems result in selection possibilities. A pneumatic or electric control, e.g., with electromagnets, is not conceivable with such a construction, since the control elements of the disengaged arms of the needle carrier and drill carrier must be under constant pressure or tension, respectively. Therefore, electromagnets require a very high connected load and the current consumption would be considerable. The variation possibilities are very limited with a selection by mechanical means, e.g., through control rollers provided with raised or recessed portions, since the selection of the needles or drills in use is limited by the variants provided on this control roller.

In another known embodiment only the needle carriers are arranged so as to be individually displaceable, wherein a control roller with projecting cams is provided in this embodiment also for selecting the needle carrier employed. The same applies in another embodiment of this type in which the control roller is provided with notches in which one end of a two-armed lever can engage. As soon as this one arm of the lever penetrates such a recess of a control roller, the latter grasps a drive element so that the corresponding needle carrier is carried along. Thus, a modification of the selection possibilities would only be conceivable if the control shafts were exchanged. However, in order to do this there would have to be a hardly surveyable bearing at such control rollers and it is possible once again that the selection can not be carried out exactly as desired.

Another known construction provides that the bearing body for the needle carriers be adjustable with respect to height, wherein a rest or neutral position with a locking action is obtained in the upper position and an engagement with a drive element is achieved in the lower position. The height adjustment is effected by means of electromagnets, wherein an additional electromagnet is required for fixing this bearing body in the upper or lower position, since otherwise the first electromagnet would have to be under continuous tension. Thus, two magnets are required for each needle carrier and, furthermore, there is no possibility in such a construction to arrange a drill or drill carrier, respectively, though this is indispensable for a correct construction of an embroidering machine. Therefore, all needles would have to be replaced by drills for a drilling process, which is not feasible.

The present invention has the object of providing a possibility so that the arms of the individually displaceable needle carriers and drill carriers can be selected individually so that there is an unlimited possibility of variation and patterns with a shuttle embroidering machine constructed in such a way.

This is achieved, according to the invention, in that individually controllable locking members engage in the swivel area of the free ends of the arms for each arm of the needle or drill carrier and, in order to disengage all arms or all arms assigned to the needle carriers and to the drill carriers, respectively, control members are provided which can be actuated in common mechanically, pneumatically and/or electrically.

Thus, on the one hand, means are provided by the present invention to raise the arms of the needle carrier and the drill carrier and to disengage the arms from the drive element, respectively, and, on the other hand, locking members are provided which provide a selection possibility.

Therefore, in selecting various needles required for an embroidering process, all arms of the needle carriers as well as of the drill carriers can first be raised by means of the control members, whereupon a selection of the locking members can then be effected which locking members engage in the swivel area of the free ends of the arms. Therefore, all those locking members assigned to those arms to be employed can be guided out of this swivel area. When the control members are guided back to their rest position the corresponding arms can reach the engagement position with the drive element; however, the other arms are kept in a disengaged position with the drive element by means of the unactuated locking members which engage in the swivel area of the free ends of these arms.

By means of such a step the locking members are controlled only briefly, namely during that time period necessary for swivelling down the arms relative to the drive element. As soon as the free end area of the corresponding arms has traversed the section of the locking members, these locking members can easily engage again in the swivel area so that the control elements for these locking members, e.g., compressed air pistons or electromagnets, must be under pressure or tension, respectively, only for a short time during the selection process. Moreover, only those locking members assigned to the arms of the corresponding needle carriers or drill carriers, which arms are to be selected, are actuated. Therefore, there is only a limited power consumption.

The object according to the invention can only be met by means of these steps, in accordance with the invention, of the cooperation of control members for raising the arms and of locking members for the selectable fixing of the arms in a disengaged position.

Only a very short time period is necessary for a selection process, wherein, moreover, a very simple construction is possible, which construction is easy to assemble and service. Thus, by means of the steps according to the invention, an individual control of all needles and drills is possible independent from a corresponding register. The pattern plurality and possibility of varying the pattern on shuttle embroidering machines is thereby greatly increased.

Other characteristic features, according to the invention, and special advantages are explained in more detail in the following description with the aid of the drawings.

Shown are:

FIG. 1, a section through the area of an embroidering machine carrying the needle carrier and drill carrier;

FIG. 2 shows the same as FIG. 1 except that an additional switching position can be seen;

FIG. 3, a top view of a partial section of the area of the embroidering machine which receives the needle carrier and the drill carrier;

Figure 1:
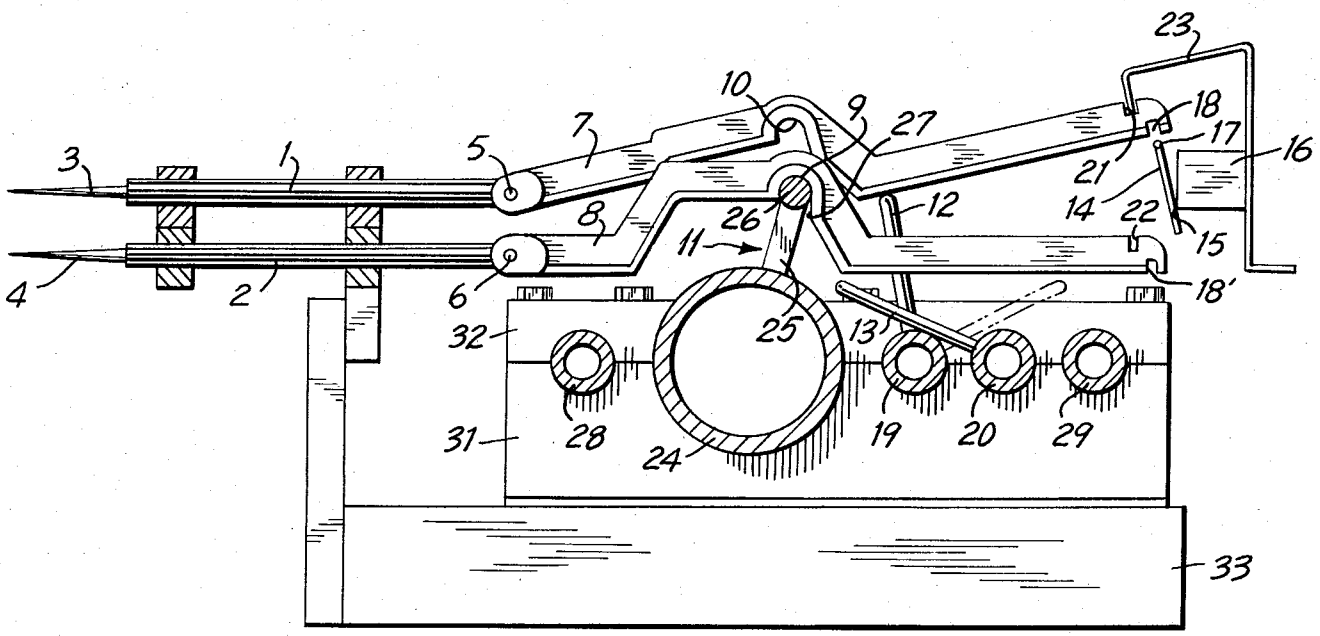
Figure 2:
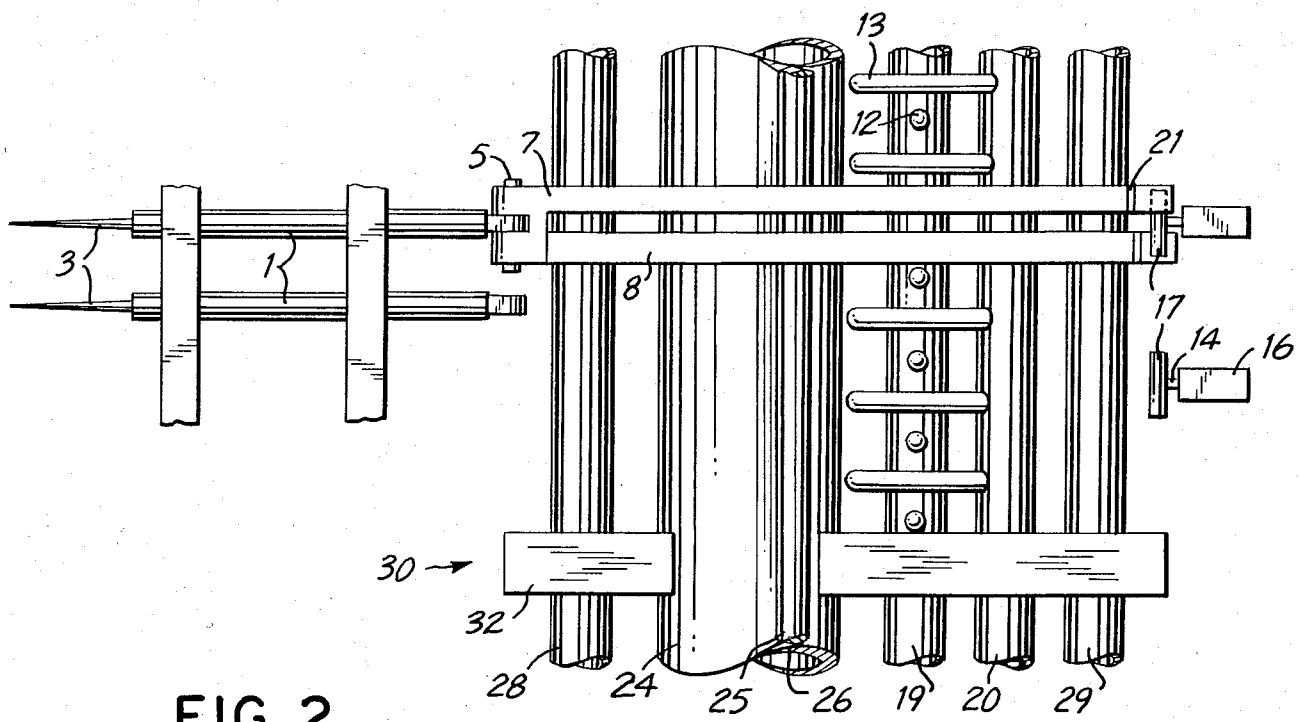
Figure 3:
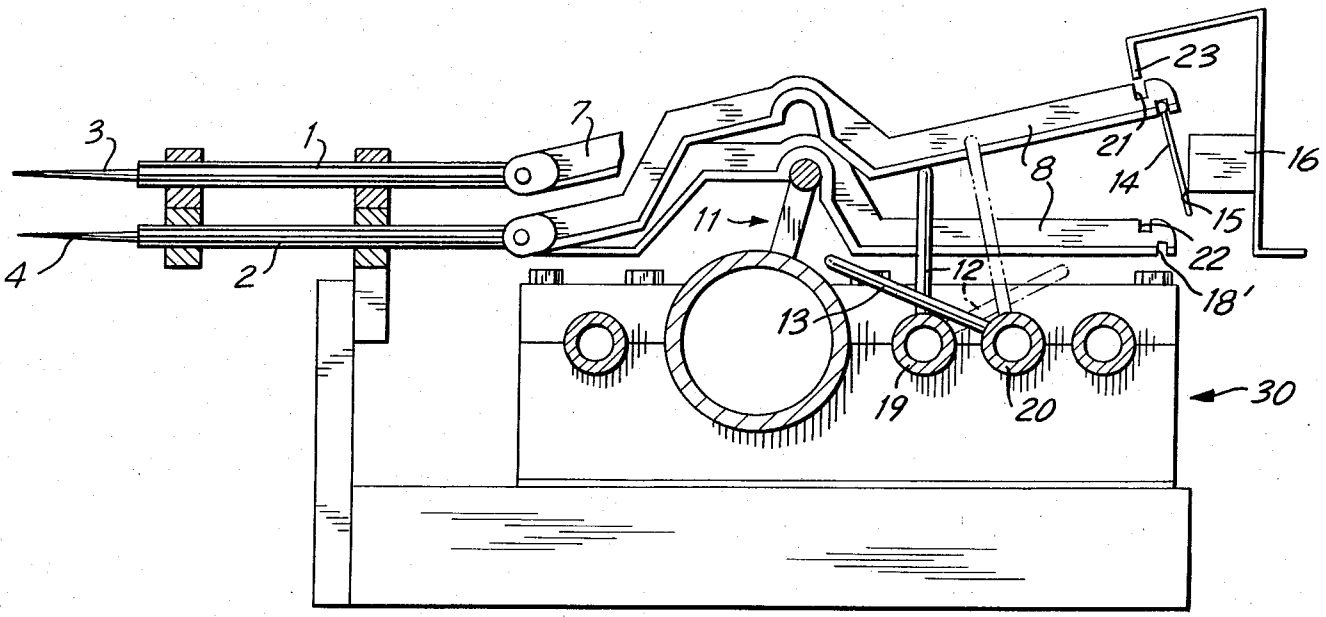

In FIGS. 1–3 only those parts of a shuttle embroidering machine are shown, with which the present invention is concerned. Therefore, the usual parts in shuttle embroidering machines, such as the embroidery frame, the shuttle path etc., are not shown. The drawings show the needle carrier 1 and drill carrier 2 with the corresponding drive elements and control elements, said needle carrier 1 and drill carrier 2 being displaceable approximately at a right angle relative to the plane of the embroidery frame. Arms 7 and 8, which are supported so as to swivel around a horizontal axis 5 and 6, respectively, are provided at the ends of the needle carrier 1 and the drill carrier 2, which ends are remote of the needles 3 and drills 4, respectively; and the arms 7 and 8 have notches 9 and 10, respectively, or corresponding projections, as well as a form-locking working connection with the drive element 11.

The arms 7 and 8 can be fixed in a lower engagement position and in an upwardly swivelled rest position, for which purpose control members 12 and 13, as well as locking members 14, are provided.

The locking members 14 engage in the swivel area of the free ends of the arms 7 and 8 and can be drawn or swivelled out of this swivel area by means of pneumatic or electric control elements. The control members 12 and 13 are provided for the disengagement of the arms 7 and 8 from the drive element 11 so that the arms 7 and 8 can be swivelled into an upper rest position by means of a corresponding movement of these control members 12 and 13.

The end areas of the arms 7 and 8 of the needle carrier 1 and the drill carrier 2 lie adjacent to one another and are thus swivelable in vertical planes lying parallel to one another. In their lower operating position these arms 7 and 8 lie at approximately the same height, substantially simplifying the arrangement of the control members and, of course, also the arrangement of the locking members. At least one arm 7 and 8 is constructed such that its end, which faces the needle or drill carriers 1 and 2, respectively, is angled so that the arms 7 and 8 can be guided relative to the needle carriers 1 and the drill carriers 2, which lie one above the other in a plane.

The locking members can be assigned to each arm 7 and 8. However, for a selection which is capable of functioning it is sufficient if such a locking member 14 is assigned to one pair of the arms 7 and 8 of a drill carrier 2 and a needle carrier 1, since it is not possible to embroider and drill simultaneously. Therefore, it is possible to select the needle carrier to be employed as well as the drill carrier 2 to be employed.

In the example shown, the locking members are constructed as arms which are supported so as to rotate, wherein the swivel axis 15 of the locking members 14 is located outside the swivel area of the free end of the arms 7 and 8. It is thereby possible for the locking members 14 to be swivelled back outside of the swivel area of the arms 7 and 8. Of course, it is also possible to provide locking members which are supported so as to be displaceable, which locking members can then be pushed forward in the swivel area of the arms 7 and 8 or drawn back out of the swivel area.

Furthermore, it is advisable if the rotational axis 15, with respect to the center of gravity of the locking members 14, is arranged so as to face away from the arms 7, 8 so that the locking members 14 are supported by means of their inherent weight in a locking position. Naturally, a similar construction is also possible when displaceably supported locking members are provided, i.e., when the displacement axis is inclined relative to the free ends of the arms 7, 8 so that the displaceably supported part can arrive in the engagement position by means of its inherent weight. Thereby, a corresponding expenditure of force by means of an air pressure control element or an electromagnet is necessary only when the locking members 14 are swivelled back or drawn back, respectively.

A very simple construction is achieved when the locking members 14 are constructed as rotatably supported arms of an electromagnet 16. A very simple and effective control is thereby also possible.

Since the locking members 14 must overlap a corresponding width in order to grasp an arm 7 and an arm 8, a cross-piece 17 extending over the width of two arms 7 and 8 can be provided at the free end of the locking members 14.

In order that the arms 7 and 8 can be fixed in a rest position by the locking members 14 and, accordingly, in order that no displacement movements of the corresponding needle carrier 1 or drill carrier 2 can result through vibrations of the machine, notches 18, 18′ are provided at the underside at the free end area of the arms, which notches 18, 18′ extend transversely relative to the longitudinal extension of the arms. Of course, these can also be corresponding grooves, boreholes, projections, or the like, in accordance with the construction of the free end of the locking members 14.

Control members 12 and 13 are assigned to each arm 7, 8 and these control members 12, 13 are constructed as pins in this embodiment example, which pins are supported to as to swivel. Thus, it must be made possible through these control members that the arms 7 and 8 can be swivelled in their upper rest position. Of course, the control members can be constructed as fingers or cams which can be swivelled or displaced. These control members can be adjusted by means of mechanical, pneumatic and/or electrically actuatable drives.

In the embodiment example shown, the control members 12 and 13 are constructed as pins projecting from rotatable shafts 19 and 20. The control members 12 assigned to the arms 7 of the needle carrier 1 are arranged at the shaft 19 and the control member 13 assigned to the arms 8 of the drill carrier 2 are arranged at the shaft 20, wherein it is advisable that the two shafts 19 and 20 have separate drive elements. These shafts 19 and 20 can be constructed so as to be continuous along the entire embroidery length, wherein it is possible to construct the two shafts 19 and 20, including the control members 12 and 13, in the same structural manner; it would also be conceivable for this purpose to give the underside of the arms 7 and 8 a corresponding curved shape so that the free ends of these arms 7 and 8 can be raised the same distance despite the different distances of the shafts 19 and 20 from the rotational axes 5 and 6. In FIGS. 1 and 2 the control members 12 are shown in their swivelled out position and the control members 13 are shown in their swivelled back rest position. The other end positions are shown in the shaded position. Thus, it can be seen that the shafts 19, 20 can be guided back into their rest position in the opposite rotational direction, wherein the pin-like control members 12 and 13 mesh with one another in this position. and, also in this position, lie beneath the displacement plane of the arms 7, 8. This is made possible in that, among other things, the free ends of the arms 7, 8 are arranged so as to lie next to one another so that the control members 12 and 13 following one another in the longitudinal direction of the embroidering machine are arranged so as to be offset relative to one another.

Substantial advantages result from the individual control possibilities of the shafts 19 and 20. Thus, if, e.g., an embroidery process is carried out all arms 8 of the drill carrier 2 must be supported in the swivelled out, upper rest position so that the control members 13 accordingly find themselves in an approximately vertical position. It is precisely by means of this step that it is also possible to assign only one locking member 14 to each pair of arms 7 and 8, since either the arms 7 or the arms 8 are already supported in their upper rest position by means of the control members 12 and 13, so that a selection of the corresponding arms 7 of the needle carrier 1 or the arms 8 of the drill carrier 2 can be effected. In a drilling process all arms 7 of the needle carrier 1 are in the upper swivelled rest position in a corresponding arrangement, wherein they are supported in this position by the corresponding control members 12.

In a selection process or adjustment process, respectively, for the individual, controllable locking members 14 the two shafts 19 and 20 are then rotated so that the two control members 12 and 13 arrive in a position in which the arms 7, as well as the arms 8, are swivelled out in their upper rest position. A selection of the required needles or drills can then be carried out in that, i.e., the locking members 14 of the corresponding arms 7 or 8 are drawn up so that after the control members 12 or the control members 13 swivel down, those arms 7 or 8 for which the path is cleared by means of the drawn up locking members 14 can swivel downward.

In order to achieve a proper functioning of the locking members 14 the swivel path of the free ends of the arms 7 and 8 must exceed the upper definition of the free end of the locking members 14. When the free ends of the arms 7 and 8 are moved upwards the locking members 14 are then pressed back and can once again swivel into their locking position after the free ends pass. Of course, it is also possible in this context to construct the locking members 14 so as to be correspondingly spring-loaded so that the effect is reinforced correspondingly by means of the inherent weight.

In order that those arms 7 or 8 which are entirely shut off, e.g., arms 8 in an embroidering process and arms 7 in a drilling process, are also fixed in their rest position recesses 21 and 22, respectively, or corresponding projections, or the like, are provided at the upper side of the arms 7 and 8 in the area of their free ends, in which recesses 21 and 22 a stationary locking element 23 engages in the uppermost swivelling end position of the arms 7, 8.

In order to ensure that the arms 7 and 8 are guided back correctly into their working position and, furthermore, to achieve a secure locking of the arms 7 and 8, respectively, engaging in the locking members 14, it is possible to construct the arms 7 and 8 so as to be spring-loaded in the direction of their working position. A corresponding spring can be provided for this purpose in the area of the rotational axes 5 and 6.

The drive element 11 for the arms 7 and 8 is constructed as a rotatably supported shaft 24 with a radially projecting actuation bar 25 extending continuously along the length of the machine. The cross-section of the free longitudinal border area 26 of the actuation bar 25 is constructed in the shape of a circular sector, wherein the recesses 9 and 10 in the arms 7 and 8 are constructed so as to be correspondingly semi-circular for this purpose. A proper transmission of force is thereby possible without bringing about notable material wear.

A downwardly, extending stop face 27, whose height approximately corresponds to the swivel path of the arms 7, 8 in this area, said stop face 27 being approximately transverse relative to the longitudinal extension of the arms 7, 8, adjoins the border of the circular recess 9 and 10, which border is remote of the needle carrier 1 and the drill carrier 2, respectively. It is thereby ensured that when the arms 7, 8 swivel they will not be displaced in their longitudinal direction, especially since the longitudinal border area 26 of the drive element 11 contacts this stop face 27 over the entire swivel area. A swivelling of the arms 7, 8 always results in this position of the drive element 11, since, in this position, the needles 3 and drills 4, respectively, must be in the drawn back state. It must be mentioned in this context that precisely when the drill 4 is driven the drive element 11 need not always guide forward and backward the entire swivel path; rather, a short-stroke drill movement can be carried out after a corresponding displacement of the drill 4. Thus, only a single drive element is provided in a simple manner for the needle carrier 1 as well as for the drill carrier 2, which amounts to a substantial constructional simplification, wherein two different eccentric drives act on the same drive element 11 in order to take into account a different movement sequence and stroke in the needles and drills.

Figure 7:
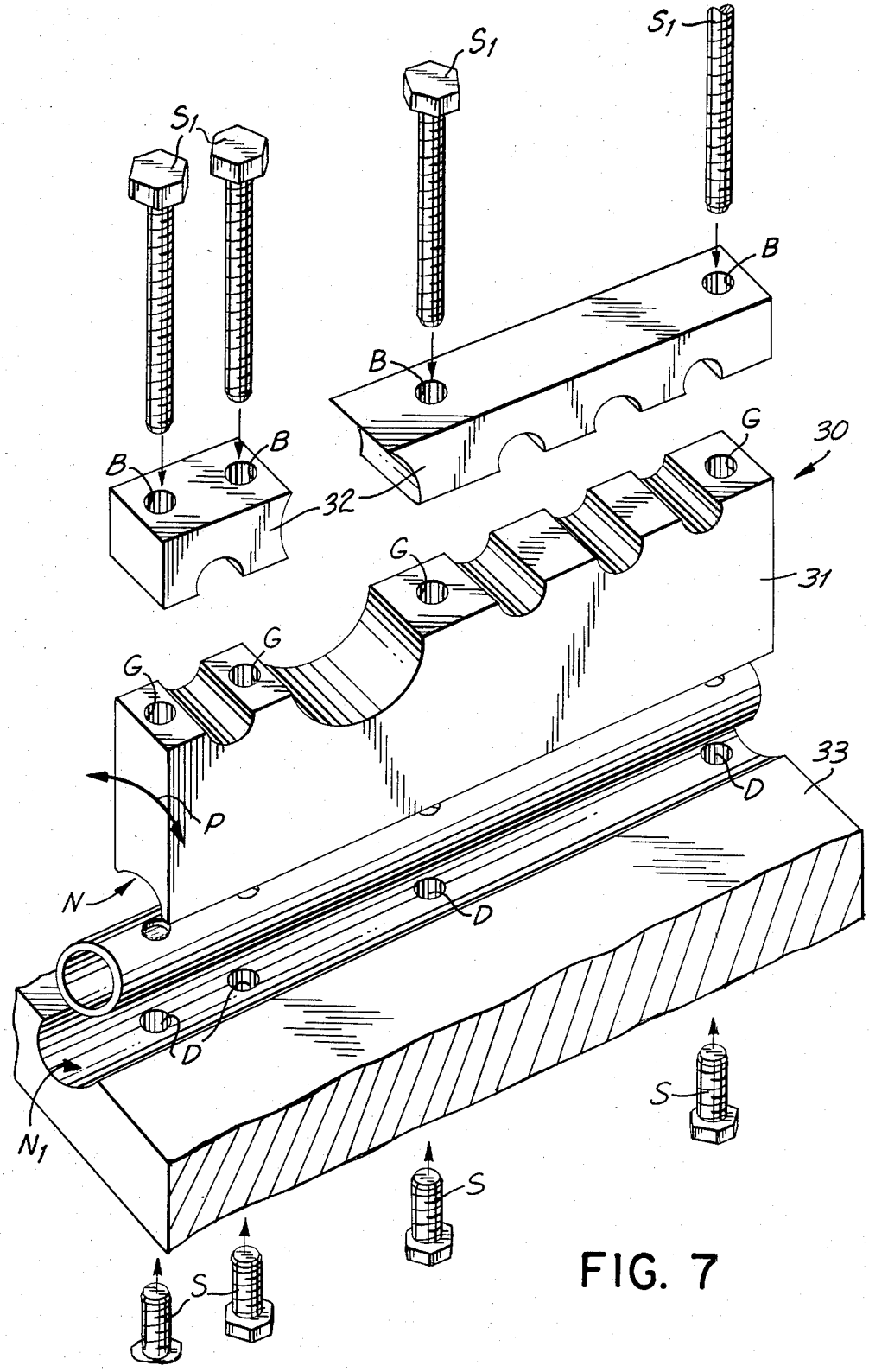
FIG. 7 is an exploded enlarged detail view of the bearing block shown in FIG. 1.

The shafts 19 and 20 receiving the control members 12 and 13, the shaft 24 forming the drive element 11 for the arms 7,8 of the needle carrier 1 and drill carrier 2, as well as other possible drive shafts and actuation shafts 28, 29 are arranged so as to lie axially parallel relative to one another on a common central plane in a constructionally simple manner. In FIG. 7, the bearing block 30 is shown in an exploded view. The lower portion 31 has a channel with a circularly shaped surface facing the carrier 33. A pipe piece R is inserted into the channel $N_1$ on the carrier 33 and into a channel N in the bottom of the lower bearing plate 31. It is then possible to pivot the lower bearing part 31 in the direction of the arrows P to afford an exact adjustment with the horizontally extending rotatable shafts. Threaded bores G are provided in the lower bearing part 31 and corresponding bores D are provided in the carrier 33 and in the pipe piece R through which screws S are inserted. As a result, the lower bearing part 31 and the carrier 33 can be tightly secured together.

After insertion of the individual shafts 19, 20, 24, 28 and 29, the upper bearing part 32 of the bearing block is set in place and screws $S_1$ are inserted into the bores B which mate with the threaded bores G in the lower bearing part 31. This means a very simple assembly and, furthermore, a simple construction of the bearing points. That is, it is provided in the construction, according to the invention, that twopiece bearing blocks 30 are provided at a distance from one another for these shafts 19, 20, 24, as well as 28 and 29. Thereby, the lower bearing part 31 can be assembled first, whereupon the shafts 19, 20, 24, 28 and 29 can be inserted transversely relative to their axial direction. Thus, no insertion in the axial direction is required, such as is necessary in corresponding drive shafts, which must be guided through corresponding bearings. Moreover, the height of the upper bearing part 32 is smaller than the radius of the shaft 24 provided as drive element for the arms 7, 8, so that the actuation bar 25 can be constructed so as to be continuous despite a good bearing of this shaft 24. The bearing blocks 30, which can be arranged accordingly at greater or smaller distances as desired, thus form no impediment for the corresponding drive elements or for the control members 12, 13. The bearing parts 31 and 32 of the bearing blocks can be manufactured in a constructionally simple manner out of self-lubricating plastics material. Moreover, it is also possible for the lower bearing part 31 to have a raised portion or groove with a circular cross-section at its defining boundary facing the carrying bar 33, which raised portion or groove engages in a corresponding circular groove or raised portion in the carrier 33. It is possible thereby to exactly compensate and adjust the bearing blocks 30 to the longitudinal axes of the shafts employed. A groove with a circular cross-section can be provided at the bearing part 31 as well as at the carrier 33 in order to achieve the same effect, wherein a bearing body with a circular cross-section, i.e., a cylinder can be employed.

Figure 6:
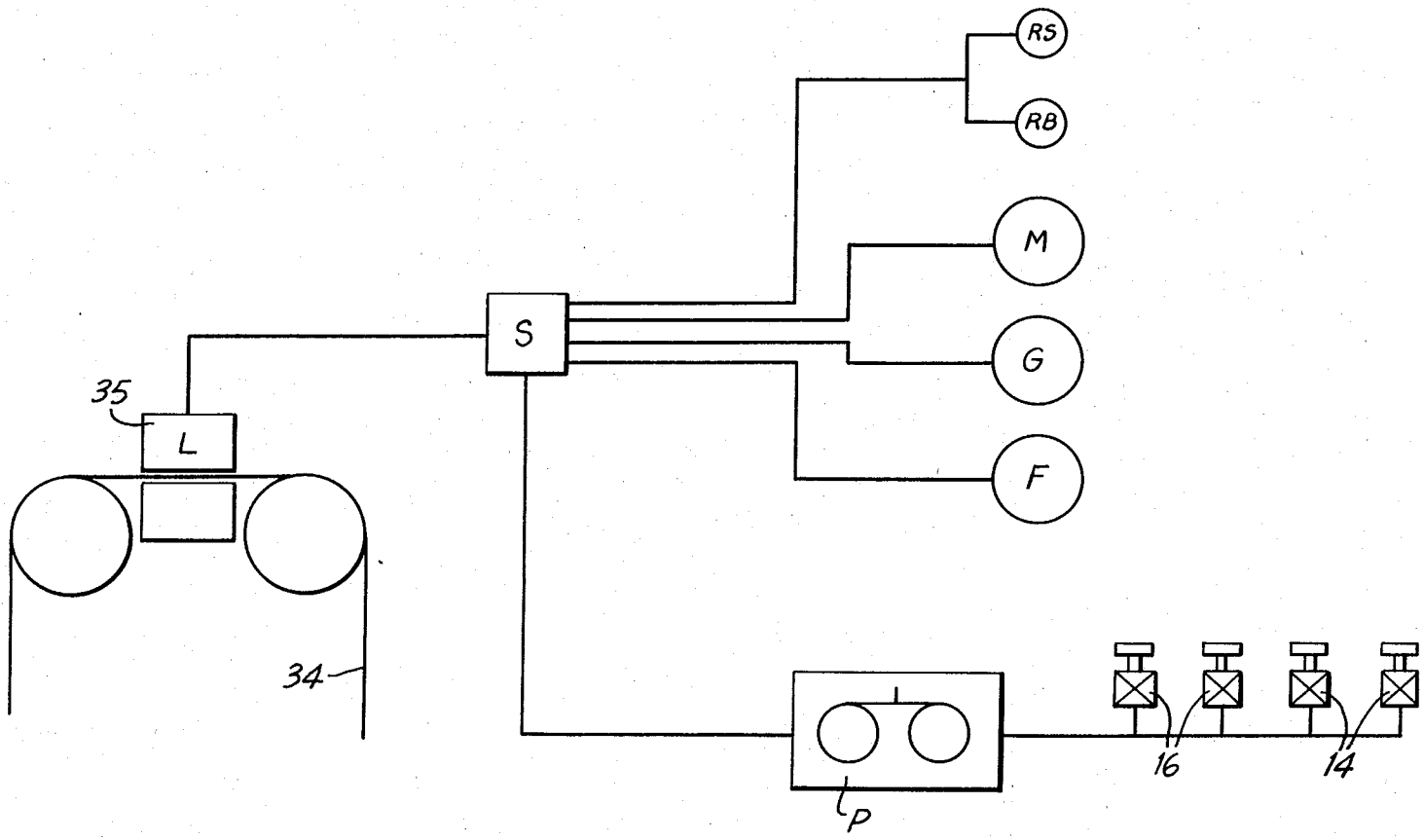
FIG. 6 shows a block circuit diagram representing the control of the arrangement according to the invention.

A conceivable control for the arrangement according to the invention can be seen in principle from FIG. 6. The control is carried out by a data carrier, e.g., a punch card 34, which is guided through a reader 35. This reader can operate mechanically, mechanically/electrically, electronically or optically, wherein it is only of importance that the corresponding control functions be transmitted to a control mechanism S. This control device S then correspondingly switches the drive motor M of the embroidering machine, a possibly separately controlled creel drive G and a separate drive F which may be provided for a thread roller. Moreover, the drives $R_S$ and $R_B$, which are assigned to the corresponding shafts 19 and 20 for the control members 12, 13, can be switched on via this control device. Accordingly, a dependence of functions is possible whereby, e.g., at the command "needle roller out" the control members 12 for the shaft 19 are correspondingly rotated and accordingly all the arms 7 of the needle carrier 1 are raised. In the opposite case, i.e., when the command "drill core out" issues from the data carrier, the drive $R_B$ is actuated so that the control members 13 are swivelled out and all arms 8 of the drill carrier 2 are raised.

Moreover, a program store P is connected to the control device, which program store P can be put into operation by means of corresponding control functions from the data carrier, e.g., the punch card 34. Therefore, it is possible to preprogram the needles 3 or drills 4, respectively, which are to be selected during an embroidering process in consecutive sections, wherein the next program position is called after a corresponding control function arrives. The selected magnets 16 or the corresponding control members 14, respectively, are then actuated so that the arms 7 or 8 assigned to these control members 14 can drop into their working position as soon as the corresponding control members 13 and 12, respectively, are swivelled back into their rest position.

Thus, a corresponding program store can be provided here from which a corresponding selection program can be called. This program store will be advisably constructed as a supplementary program in addition to the data carrier, e.g., as magnetic tape which is preprogrammed already during production of the punch card so that a mutual matching is possible. Of course, other possibilities for such a program store are also conceivable. Different possibilities for a triggering control function of the data carrier, e.g., of a punch card, also exist. Thus, it would be conceivable that a continued switching to the next program would be effected by means of a so-called "punch hole" or in dependence on the arrangement of a "stop hole". Furthermore, it would be conceivable to skip different programs, namely be providing two or more such "punch holes" behind one another in the punch card. In an electric control issuing from the data carrier it is also readily possible to make use of all information possibilities of the data carrier, e.g., of a punch card. For instance, a switching can be effected by means of a "stop hole" provided simultaneously with a "punch hole", which switching does not take over the perforations for the next reading step as information for a corresponding creel movement, but as special information for the program selection of the program store.

Of course, a construction in which a manual engagement is possible is also conceivable. It would then be possible, on the one hand, to manually select the locking members or a selection control can be provided which can be triggered manually or independently from the program store. Indicators could then be provided, for example, which indicate the numbers of the needles or drills to be selected correspondingly. It is provided that the program store for the locking members 14 can be called in dependence on the position of the control members 12 and 13 in question so that a proper switching over and selection of the locking members can be effected. Therefore, a selection and, accordingly, a swivelling out of the locking members 14 can only be effected in a non-locking position when the control members 12 and 13 are completely swivelled out, i.e., when all arms 7 and 8 are located in their upper rest position.

For the sake of clarity various constructional parts to be provided additionally were not shown in the drawings. Thus, it is completely possible to provide manually actuatable levers which can swivel the arms 7, 8 into their upper rest position and lock them there independently of the control members 12, 13. Accordingly, an additional engagement in the program sequence pregiven from the punch card 34 and the program store P is possible. Moreover, it is possible to arrange actuation levers in a constructionally simple manner, which actuation levers engage in the swivel area of the arms 7 of the needle carrier 1, wherein these actuation levers are provided for the adjustment of thread rollers which can be pressed against a driven thread roller or serve in the form only of thread brakes. Such actuation levers and individual thread rollers are known in various embodiment variants, e.g., from CH-PS Nos. 82 781 and 104 305.

Of course, various structural embodiment variations are possible within the framework of the invention; however, the basic conditions, namely the arrangement of control members 12 and 13, respectively, and the arrangement of locking members 14, must always be present. Thus, it would be conceivable to arrange the control members 12 and 13 at a common shaft so as to be offset by a corresponding angle so that either the arms 7 or the arms 8 remain in the rest position and can be securely locked accordingly. In such a case, however, there must be a third adjustment possibility in addition, in which all the arms 7 and 8 of the needle carrier 1 as well as of the drill carrier 2 are swivelled into the upper rest position so that an additional row of control members is provided so as to be offset by another section, wherein control members are provided in this row for all successive arms 7 and 8. However, in construction, as well as in reference to the drive possibilities, the arrangement shown in the drawing with two separate shafts 19 and 20 is preferred.

Figure 4:
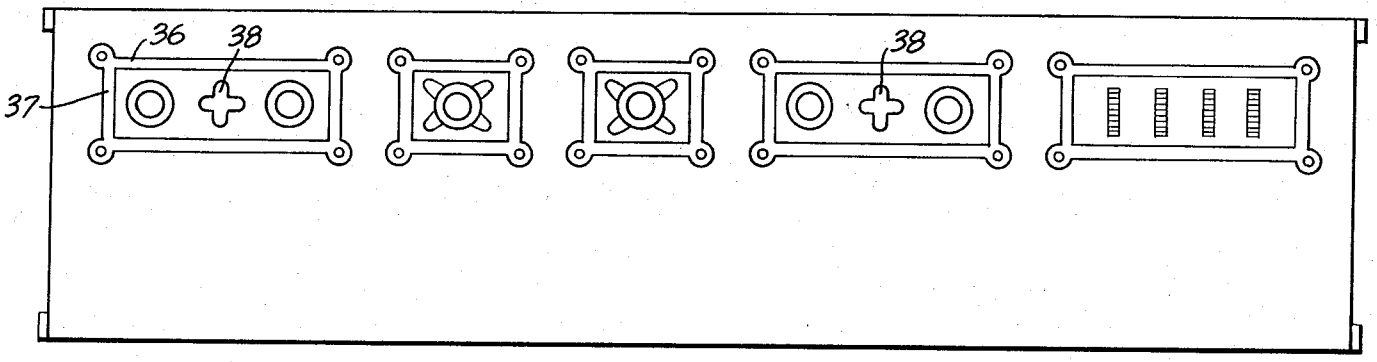
FIG. 4 is a schematic drawing of an embroidery base with an embroidery pattern entered in it.
Figure 5:
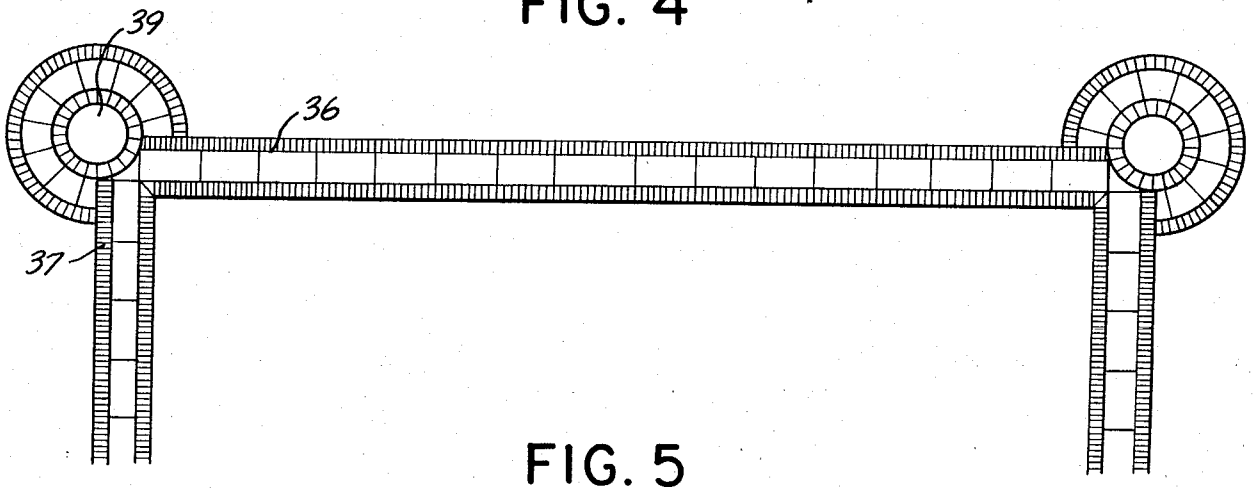
FIG. 5 shows an enlarged drawing of a part of this embroidery pattern.

A pattern to be embroidered is shown by way of example in FIGS. 4 and 5. For example, 1,400 needles can be provided on the length of an embroidering machine, wherein it is possible only through the steps according to the invention to select individual needles as desired so that a substantially greater plurality of patterns can be achieved. If, for instance, one should embroider approximately rectangular decorative covers, stitch sections 36 extending in the horizontal direction, stitch sections 37 extending in the vertical direction are provided in addition to various pattern sections. Therefore, the horizontal stitch sections can be embroidered first after selecting the required needles, whereupon an embroidering of the vertical stitch sections 37 must follow. However, few needles are needed for this purpose: for example, needles nos. 4, 290, 300, 700 etc. This vertical stitch section can then be produced only by allowing for the corresponding needles. Then, the same pattern sections 38 can be embroidered, for example, by selecting the necessary embroidering needles. Also, only the appropriate drills are to be selected for the production of the holes 39 for the production of the corners of this cover, and only the corresponding needles are to be selected for the production of the circular terminations of these corners. Thus, by making use of the full embroidery width, a desired number of possibilities is given to produce completely different pattern sections, which are the same in sections or which reach over only a small section; this was previously possible with known constructions only through manual removal of individual needles and individually unscrewing or inserting drills. Of course, one can also adjust according to a register usually used in embroidering machines, for example, between the 4/4 and the 108/4 register. However, one can also carry out an individual selection possibility independent from any one register.

In the following another work sequence of the construction of an embroidering machine according to the invention is to be explained in more detail: when one is drilling, e.g., in a 4/4 register, then all arms 8 are in the lower working position and the drive element 11 engages in the recess 9 of the arm 8. In this position the control members 12 are in the fully drawn out position in FIGS. 1 and 2; that is, the arms 7 of the needle carrier 1 are in their upper rest position, wherein the stationary locking element 23 engages in the recesses 21. The drilling process is performed by means of a corresponding reciprocating rotational movement of the shaft 24. Should a conversion be carried out from the drilling process to the embroidering process, then the control members 13 are swivelled into the position shown as a shaded area so that all arms 8 are swivelled in their upper rest position. The locking members 14 are pressed back through the ends of the arms 8 and jump back again into their locking position after the passing of the arms 8. When the control members 12 and the control members 15 swivel down the arms 7 and 8 could not longer attain their downward working position, for then the locking members 14 would engage in the recesses 18, 18′ at the free ends of the arms 7 and 8. Thus, when an embroidery process is to be carried out the arm 7 as well as the arm 8 are first in their upper rest position. A selection of the required needles 3 is now effected in that those locking members 14 which are to be coupled with the drive element 11 are drawn up by means of the magnet 16. Then, the control members 13 are swivelled down so that the arms 7 of the needle carrier 1 can swivel downward. However, only those arms 7 in which the assigned locking members 14 are drawn up, that is, taken out of the swivel area of the arms 7, swivel downward. All the other arms 7 are supported when the locking members 14 move downward, wherein the free ends of the locking members 14 engage in the recesses 18. In this position, the control members 13 are in the shaded position so that the arms 8 of the drill carrier 2 remain in their upper end rest position.

Thus, in an embroidery process all arms 8 are locked in their upper rest position by means of the control members 13. In a drilling process, on the other hand, all arms 7 of the needle carrier 1 are supported in their upper rest position by means of the control members 12. The locking members 14 therefore act upon the arms 7 or 8 accordingly depending on whether an embroidering process or a drilling process takes place. In this way it is possible to provide only one locking member 14 for a pair of a needle carrier 1 and a drill carrier 2 or for the corresponding arms 7 and 8, respectively.

The drive for the shafts 19, 20 and 24 can be effected in a simple manner by means of a crank gear, wherein the connection is effected in such a way that the drive is carried out in only one rotational direction and a swivelling movement is obtained by means of transmission of a crank gear. Of course, step motors are also conceivable for the shafts 19 and 20. It would also be possible to provide a common drive, wherein, however, corresponding clutch members are to be provided in order to drive either the shaft 19 or the shaft 20 or both shafts in the opposite direction.

In the foregoing description it was mentioned that a separation of the selection of the arms 7 of the needle carriers 1 and of the arms 8 of the drill carrier 2 is possible. It would also be conceivable in a special pattern construction to embroider as well as drill with a coordination of the distance between drills and needles. Of course, this can only be carried out in exceptional cases, since the embroidery creel carries out the same relative movement with reference to the needles and the drills. However, it is possible by means of the steps according to the invention to simultaneously drive needles and drills, wherein, however, the needles and drills carry out the same movement sequence. If there is a selection possibility of the drill independently of the selected needles, then separately controllable blocking members 14 must be assigned to all arms 7 of the needle carrier 1 and to all arms 8 of the drill carrier 2.

In the above description an embodiment was described in which a needle carrier or drill carrier, respectively, is assigned to each individual needle and to each individual drill, wherein these individual needle and drill carriers are supported in guide bushes of a stationary machine part. The steps, according to the invention, are, of course, also applicable in a simple embroidering machine construction in which all needles or groups of needles and, in a corresponding way, the drills are arranged on common or shared needle carrier bars or drill carrier bars, respectively. According to the length of these needle or drill carrier bars, they are assigned one or more arms 7 or 8, respectively, which are then coupled with the single drive element 11 in the same manner or which can be raised from the latter, respectively. The locking members 14 and the control members 12 and 13 can be employed in a similar manner. Such a step is, e.g., specially suited for the modification of existing embroidering machines, A number of drive elements, cam plates, pendulating masses etc. are dispensed with alone through such a step. The steps according to the invention thus represent an excellent possibility of providing a single drive for the needles and the drills with the corresponding control possibilities.

I claim:

1. Shuttle embroidering machine comprising a plurality of elongated horizontally arranged needle carriers and of elongated horizontally arranged drill carriers arranged to be displaced approximately at right angles relative to the plane of an embroidery frame, each said needle carrier and drill carrier having a first end and a second end, a needle inserted into the first end of each said needle carrier, a drill inserted into the first end of each said drill carrier, a generally horizontally extending first arm attached to the second end of each said needle carrier, a generally horizontally extending second arm attached to the second end of each said drill carrier, each of said first and second arms being pivotally displaceable about a horizontal axis, each of said first and second arms having a first end and a second end with said first ends of said first and second arms being connected to the second ends of the respective said needle carriers and drill carriers, a drive element for the operative displacement of said needle carriers and drill carriers, said first and second arms being shaped for selective and form-locking engagement with said drive element, wherein the improvement comprises that the second ends of said first and second arms being displaceable along a vertical path when said first and second arms are pivotally displaced, individually controllable locking members located in the vertical path of displacement of the second ends of said first and second arms for selective locking engagement with said first and second arms, first control members engageable with said first arms and second control members engageable with said second arms for selectively pivoting said first and second arms into and out of locking engagement with said locking arms.

2. Shuttle embroidering machine, as set forth in claim 1, wherein said locking members are movably displaceable into locking engagement with the second ends of said first and second arms.

3. Shuttle embroidering machine, as set forth in claim 1, wherein said locking members are pivotally supported for displacement into locking engagement with the second ends of said first and second arms.

4. Shuttle embroidering machine, as set forth in claim 2, wherein said locking members are pivotally displaceable about an axis extending parallel to the axis of pivotal displacement of said first and second arms, the pivotal axis of said locking members being located outside the path of movement of the second ends of said first and second arms and the pivotal axis of said locking members being arranged remotely from said first and second arms with reference to the center of gravity of said first and second arms.

5. Shuttle embroidering machine, as set forth in claim 1, wherein said locking members include a rotatably supported arm and an electromagnet operatively connected to said arm.

6. Shuttle embroidering machine, as set forth in claim 1, wherein the end portion of one of said first and second arms extending from the first end thereof having an angled portion.

7. Shuttle embroidering machine, as set forth in claim 1, wherein said needle carriers and drill carriers are in alternating arrangement so that one said needle carrier is located adjacent to one said drill carrier, one said locking member arranged for each said pair of one said needle arm and one said drill carrier.

8. Shuttle embroidering machine, as set forth in claim 7, wherein each said locking member has a free end, a cross-piece located at said free end and extending for a length equal at least to the space between the adjacent pair of one said needle carrier and one said drill carrier.

9. Shuttle embroidering machine, as set forth in claim 8, wherein each of said first and second arms have an upper side and an underside, a notch formed in the underside of each of said first and second arms adjacent the second ends thereof, and said notch forming a catch recess for the free end of said locking member.

10. Shuttle embroidering machine, as set forth in claim 7, wherein the second ends of said first and second arms being movable along a pivotal path and said pivotal path extending beyond the limit of the free end of the associated said locking member.

11. Shuttle embroidering machine, as set forth in claim 1, wherein one said control member is assigned to each one of said first and second arms, and each said control member is constructed as a pivotally displaceable member.

12. Shuttle embroidering machine, as set forth in claim 11, wherein said needle carriers and drill carriers are arranged in pairs of one said needle carrier and one said drill carrier, a first drive element for said first control members and a second drive element for said second drive members with said first and second drive elements being separate for selectively displacing said first and second control members.

13. Shuttle embroidering machine, as set forth in claim 11, wherein said first and second control members are formed as pins, a first rotatable shaft for said first control members and a second rotatable shaft for said second control members and said pins projecting radially outwardly from said shafts for selectively displacing said first and second arms.

14. Shuttle embroidering machine, as set forth in claim 13, wherein said drive elements extend perpendicularly of the elongated direction of said first and second arms and said shafts mounting said pins extend transversely for the full extent of said first and second arms, and separately controllable drive members for said first and second shafts.

15. Shuttle embroidering machine, as set forth in claim 14, wherein said first and second shafts rotatably supporting said control members are oppositely rotatable relative to one another so that said control members are disposed in intermeshed engagement when said control members are not displacing said first and second arms.

16. Shuttle embroidering machine, as set forth in claim 1, wherein the second ends of said first and second arm have recesses therein, a stationary locking element adjacent the second ends of said first and second arms and said stationary locking element being engageable in said recesses in the second ends of said first and second arms.

17. Shuttle embroidering machine, as set forth in claim 16, wherein said first and second arms are pivotally displaceable between a working position and a resting position, and said first and second arms being spring-loaded toward the working position.

18. Shuttle embroidering machine, as set forth in claim 1, wherein said drive element for said first and second arms is a rotatably supported shaft with a radially projecting actuating bar extending for the full extent of said needle carriers and drill carriers transversely of the elongated direction of said needle carriers and drill carriers.

19. Shuttle embroidering machine, as set forth in claim 18, wherein the end of said actuating bar radially outwardly from said shaft is circularly shaped and each of said first and second arms have a corresponding semi-circular recess therein arranged to receive the circularly shaped end of said actuating bar.

20. Shuttle embroidering machine, as set forth in claim 19, wherein each of said first and second arms has a downwardly extending stop face projecting downwardly from said semi-circular recess on the side of said recess more remote from said needle carrier and drill carrier, and the height of said stop face corresponding approximately to the path of displacement of said first and second arms in the region of said semi-circular recess.

21. Shuttle embroidering machine, as set forth in claim 18, wherein said shafts for said control members and said shaft for said drive element extend in parallel relation relative to one another.

22. Shuttle embroidering machine, as set forth in claim 21, wherein two-piece bearing blocks are disposed in spaced relation at the opposite ends of said shafts for said control member and said shaft for said drive element, said bearing blocks each comprising an upper bearing part and a lower bearing part and said upper bearing part having a height less than the radius of said shaft for said drive element.

23. Shuttle embroidering machine, as set forth in claim 1, including a drive for each of said shafts for said control members, an electromagnet for each of said locking members, and a punch card for controlling the operation of said drives and said electromagnet as a function of control features incorporated into said punch card.

24. Shuttle embroidering machine, as set forth in claim 23, including a program store for controlling said locking members, and said program store being operable via said punch card.

25. Shuttle embroidering machine, as set forth in claim 24, wherein said program store for said locking members can be operated as a function of the position of said control members.

26. Shuttle embroidering machine, as set forth in claim 23, wherein selected said locking members can be pivotally displaced by an associated said electromagnet into a position outside the pivotally displaceable path of the second ends of said arms.

27. Shuttle embroidering machine, as set forth in claim 25, wherein said program store for said locking members is in the form of a supplemental magnetic tape matched with said punch card.

28. Shuttle embroidering machine, as set forth in claim 1, wherein said locking members are selectively engageable with said arms and means for manually engaging said locking members with said first and second arms.

* * * * *